United States Patent [19]

Hattori et al.

[11] 4,146,000

[45] Mar. 27, 1979

[54] AIR FLOW CONTROL SYSTEM

[75] Inventors: Tadashi Hattori, Okazaki; Akira Takata; Tamotsu Fukuda, both of Toyota; Takamichi Nakase, Gamagori, all of Japan

[73] Assignees: Nippon Soken, Inc., Nishio; Toyota Jidosha Kogyo Kabushiki Kaisha, Toyota, both of Japan

[21] Appl. No.: 803,936

[22] Filed: Jun. 6, 1977

[30] Foreign Application Priority Data

Jun. 22, 1976 [JP] Japan ..... 51-73716

[51] Int. Cl.[2] ..... F02B 3/02; F02B 3/08; F02M 7/12

[52] U.S. Cl. ..... 123/32 EL; 123/32 EE; 123/119 EC

[58] Field of Search ..... 123/32 EE, 32 EL, 32 EH, 123/119 EC; 60/276, 285

[56] References Cited

U.S. PATENT DOCUMENTS

| | | | |
|---|---|---|---|
| 3,759,232 | 9/1973 | Wahl et al. | 123/32 EE |
| 4,007,718 | 2/1977 | Laprade et al. | 123/32 EE |
| 4,020,813 | 5/1977 | Hattori et al. | 60/285 |
| 4,052,968 | 10/1977 | Hattori et al. | 123/119 EC |
| 4,062,337 | 12/1977 | Rivere | 123/32 EE |
| 4,072,137 | 2/1978 | Hattori et al. | 123/119 EC |
| 4,075,835 | 2/1978 | Hattori et al. | 123/119 EC |

*Primary Examiner*—Charles J. Myhre

*Assistant Examiner*—P. S. Lall

*Attorney, Agent, or Firm*—Cushman, Darby & Cushman

[57] ABSTRACT

In an air flow control system including a gas sensor for detecting the concentration of a constituent of the exhaust gases from an internal combustion engine, an air passage for supplying additional air into the intake system or exhaust system of the engine, a by-pass valve for varying the passage area of the additional air passage, and means for controlling the opening and closing of the by-pass valve in accordance with the detection signal from the gas sensor whereby the amount of additional air supplied into the intake system or exhaust system of the engine is controlled in accordance with the concentration of the constituent of the exhaust gases, there is further provided an acceleration/deceleration sensor for detecting acceleration or deceleration of the engine, whereby when a transition from the acceleration or deceleration operating condition to the steady-state operating condition is detected, the opening and closing control of the by-pass valve is accomplished in such a manner that the amount of opening and closing movement of the by-pass valve is gradually decreased. Thus, when the engine comes into the steady-state operation from the transient operation, the rate of change in the opening of the by-pass valve is gradually decreased to reduce variation of the air-fuel ratio upon the transition from the acceleration/deceleration operation to the constant speed operation.

5 Claims, 5 Drawing Figures

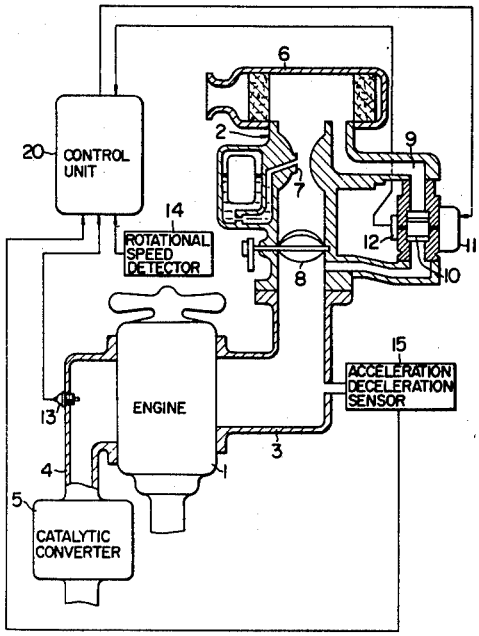

AIR FLOW CONTROL SYSTEM

The present invention relates to air flow control systems. More particularly, the invention relates to an air flow control system for controlling the amount of additional air in such manner that the air-fuel ratio of the mixture supplied to an engine is always maintained within a proper range or the amount of secondary air supplied to the catalyst is controlled at a proper value.

To ensure maximum efficiency of modified engines which have been proposed for automotive exhaust emission control purposes or to ensure maximum purification of exhaust gases by the exhaust gas purifying catalysts mounted in engines for exhaust emission control purposes, the air-fuel ratio of the mixture supplied to the engine must always be controlled properly or the amount of secondary air must always be controlled properly. This invention relates to an air flow control system which meets these requirements satisfactorily.

Conventionally, an air flow control system of the above type has been proposed which comprises a gas sensor for detecting the air-fuel ratio of the mixture supplied to an engine in terms of the concentration of oxygen which is a constituent in the exhaust gases etc., and a by-pass valve adapted to be continuously operated in response to the signal from the gas sensor, whereby the amount of air additionally supplied through an air passage is controlled to control the air-fuel ratio of the mixtures.

A disadvantage of this type of prior art systems is that since the system of the integral control type in which the opening of the by-pass valve is gradually decreased or increased, even if the driving speed of the by-pass valve is preset to an optimum valve, due to the driving speed being constant, a delay will be caused in the response during the periods of acceleration, deceleration and the like where the air-fuel ratio is changed rapidly. Another disadvantage is that during the low load and low speed range of the engine, the system delay time between the instant that the air-fuel ratio is changed in the intake system and the instant that the change is detected by the gas sensor in the exhaust system will be increased, thus causing an excessive control and thereby increasing variation of the air-fuel ratio. Still another disadvantage is that even if it is desired to simply increase the driving speed of the by-pass valve during the periods of acceleration and deceleration, for example, the control is continued in a stepwise manner during transition from the acceleration/deceleration operation to the steady-state operation, so that depending on the position (opening) of the by-pass valve, the control of additional air during the steady-state operation is affected greatly and variation of the air-fuel ratio is increased.

Consequently, there is a problem in that the catalytic converter cannot act with high efficiency thus failing to satisfactorily purify exhaust gases, and that a surging phenomenon is caused during the running of the vehicle thus deteriorating the drivability.

The present invention has been made in view of these circumstances, and it is an object of the invention to provide an improved air flow control system having an improved intermediary characteristic during transition from the acceleration/deceleration operation to the steady-state operation, thus making variation of the air-fuel ratio small and thereby ensuring improved exhaust gas purification as well as improved drivability.

It is another object of this invention to provide such air flow control system which is capable of satisfactorily controlling the amount of additional air throughout a wide range of operating conditions of an engine, thereby reducing variation of the air-fuel ratio.

The system of this invention has among its great advantages the fact that in controlling the flow rate of additional air, the control can be effected without causing a delay in the response upon transition from the acceleration/deceleration operation or the transient engine operation to the steady-state operation and thus variation of the air-fuel ratio can be decreased.

Another great advantage of the system of this invention is that in controlling the flow rate of additional air, the control can be accomplished without causing a delay in the response during the periods of acceleration and deceleration or transient engine operations, and during low speed operation the occurrence of overshooting control can be prevented, thus ensuring improved follow up or response to suit a wide variety of the engine operating conditions.

Another great advantage is that by properly controlling the air-fuel ratio of the mixtures, the catalytic converter can be made to operate highly efficiently, thus satisfactorily reducing exhaust emissions and ensuring improved drivability.

The above and other objects, features and advantages of the invention will become readily apparent by considering the following detailed description in conjunction with the accompanying drawings, in which.

Figure 1:
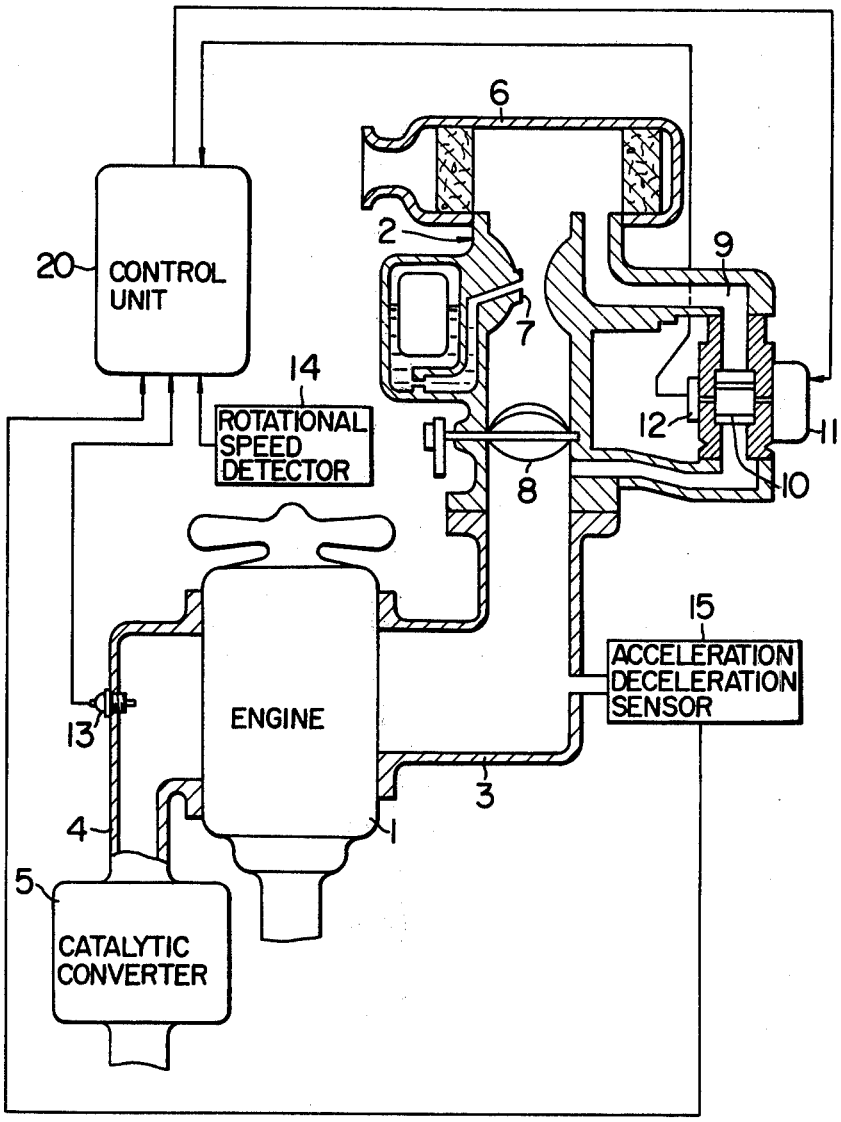
FIG. 1 is a schematic diagram showing the construction of an embodiment of the invention.

The present invention will now be described in greater detail with reference to the illustrated embodiment. Referring to FIG. 1 showing the system construction, an engine 1 is an ordinary four-cycle reciprocating engine using gasoline or LP gas as fuel, and it is supplied with air-fuel mixture from a carburetor 2 through an intake manifold 3. After the mixture has been burned, the engine 1 discharges the exhaust gases into an exhaust manifold 4 from which the exhaust gases are discharged to the atmosphere through a catalytic converter 5 disposed in the downstream portion of the exhaust manifold 4 and a muffler which is not shown.

The catalytic converter 5 is adapted to purify the harmful constituents in the exhaust gases, and it incorporates, for example, a three-way catalyst which purifies NOx, CO and HC simultaneously.

The carburetor 2 is of the ordinary type in which fuel is mixed with the air supplied from an air cleaner 6 and then atomized. More specifically, an amount of fuel substantially proportional to the amount of air drawn is delivered from a fuel nozzle 7 which is opened to the venturi section, and the amount of air drawn is adjustable by a throttle valve 8 mounted downstream of the fuel nozzle 7 and adapted to be operated as desired. Also an air passage for correction 9 is provided to by-pass the fuel nozzle 7 and the throttle valve 8 and communicate the air cleaner 6 with the carburetor portion downstream of the throttle valve 8 for supplying additional air, and the air passage for correction 9 is provided with a butterfly type by-pass valve 10 operable to vary its passage area and a four-phase pulse motor 11 coupled to the by-pass valve 10 and constituting a drive unit for opening and closing the by-pass valve 10.

A fully closed position sensor 12 is coupled to the by-pass valve 10 to detect that the by-pass valve 10 is in its fully closed position, and it is designed so that when the by-pass valve 10 is in the fully closed position, its contacts are closed and the resulting electric signal is applied to a control unit 20.

Figure 2:
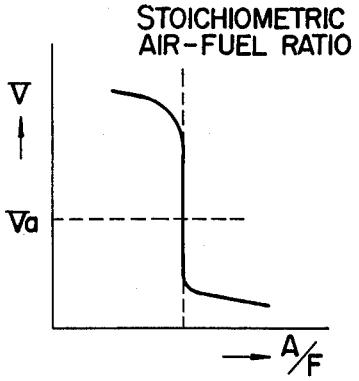
FIG. 2 is an output characteristic diagram of the gas sensor shown in FIG. 1.

A gas sensor 13 is mounted in the exhaust system of the engine 1, e.g., at the converging point of the exhaust manifold 4 so as to detect the concentration of an exhaust gas constitutent and thereby detect the air-fuel ratio of the mixture which is correlated with the concentration of the constituent, and its detecting means comprises a metal oxide such as zirconium dioxide or titanium dioxide. In the case of the gas sensor 13 employing zirconium dioxide, for example, as shown in FIG. 2, the gas sensor 13 produces an electromotive force of about 1 V when the mixture supplied to the engine 1 is thick or rich as compared with the stoichiometric (theoretical) air-fuel ratio, whereas an electromotive force of 100 mV is produced when the mixture supplied is thin or less as compared with the stoichiometric air-fuel ratio, and the output electromotive force changes is a stepwise manner at around the stoichiometric ratio.

A rotational speed detector 14 is adapted to generate a signal in synchronism with the crackshaft revolution of the engine 1 or in accordance with the rotational speed of the engine 1, and in this embodiment the intermittent signal generated at the primary winding negative terminal of the ignition coil generally employed as the ignition system of the engine 1 is utilized, and this output signal is applied to the control unit 20.

Figure 3:
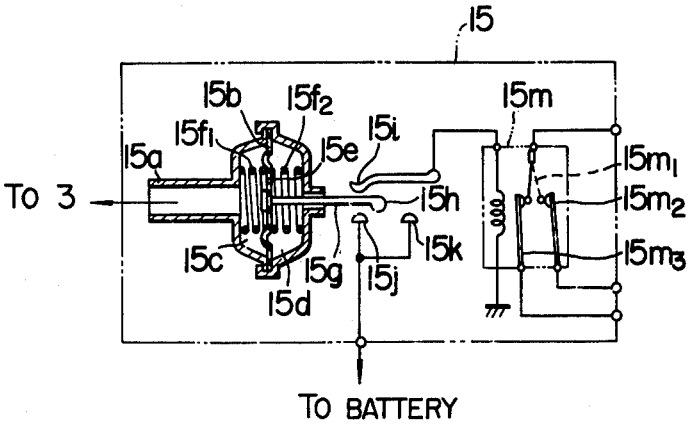
FIG. 3 is a sectional view showing the construction of the acceleration/deceleration sensor shown in FIG. 1.

An acceleration/deceleration sensor 15 is mounted in the intake manifold 3 and its switch is electrically turned on and off in response to changes in the intake manifold vacuum, namely, the switch is turned on during the periods of acceleration and deceleration, for example, where the intake vacuum changes rapidly, and its output signal is applied to the control unit 20. As shown in FIG. 3, the construction of the acceleration/deceleration sensor 15 is of the diaphragm type. Referring to FIG. 3, the sensor 15 includes two chambers **15*c* and 15*d* which are defined by a casing 15*a* and a diaphragm 15*b*, and the chambers are communicated with each other through an orifice jet 15*e* in the diaphragm 15*b*. Also back springs $15f_1$ and $15f_2$ are respectively mounted in the chambers 15*c* and 15*d* to urge the diaphragm 15*b*, and the chamber 15*c* is communicated with the intake manifold 3. An electrically conductive shaft 15*g* is securely attached to the diaphragm 15*b*, and a contact 15*h* is formed at the forward end of the shaft 15*g*. A slide terminal 15*i* is disposed so as to always contact with the shaft 15*g*, and terminals 15*j* and 15*k* are disposed to contact with the shaft 15*g* at the predetermined positions thereof. A relay 15*m* is operable in accordance with the engagement and disengagement of the terminal 15*g* with the terminals 15*j* and 15*k*, namely, contacts $15m_1$ and $15m_2$ are closed when the terminals are connected or engaged, and the contacts $15m_1$ and $15m_3$ are closed when the terminals are disconnected or disengaged. Thus, the position of the relay 15 is changed depending upon whether the engine 1** is at the acceleration or deceleration operation.

Next, the control unit 20 will be described in detail with reference to FIG. 4. In the Figure, an A/F discriminating circuit **20*a* comprises a voltage comparison circuit including an input resistor 101, voltage dividing resistors 102 and 103 and a differential operational amplifier 104 (hereinafter referred to as an OP AMP), and its preset level determined by the dividing resistors 102 and 103 is set at a voltage $V_a$ (FIG. 2) produced by the gas sensor 13 at around the stoichiometric air-fuel ratio. Consequently, when the air-fuel ratio detected by the gas sensor 13 is smaller than the stoichiometric ratio or the mixture is thicker, the OP AMP 104 generates a "1" level signal, whereas the OP AMP 104 generates a "0" level signal when the detected air-fuel ratio is greater than the stoichiometric ratio or the mixture is thinner. A filter circuit 20*b* comprises a first trigger circuit including two monostable multivibrators formed with resistors 105 and 107, capacitors 106 and 108, inverters 110 and 111 and NAND gates 112 and 113, an inverter 109 and a NAND gate 114, and a timer circuit including an astable multivibrator formed with resistors 115 and 116, a capacitor 117 and inverters 118 and 119, binary counters 120 and 123, an inverter 121 and NAND gates 122 and 124**.

Figure 5:
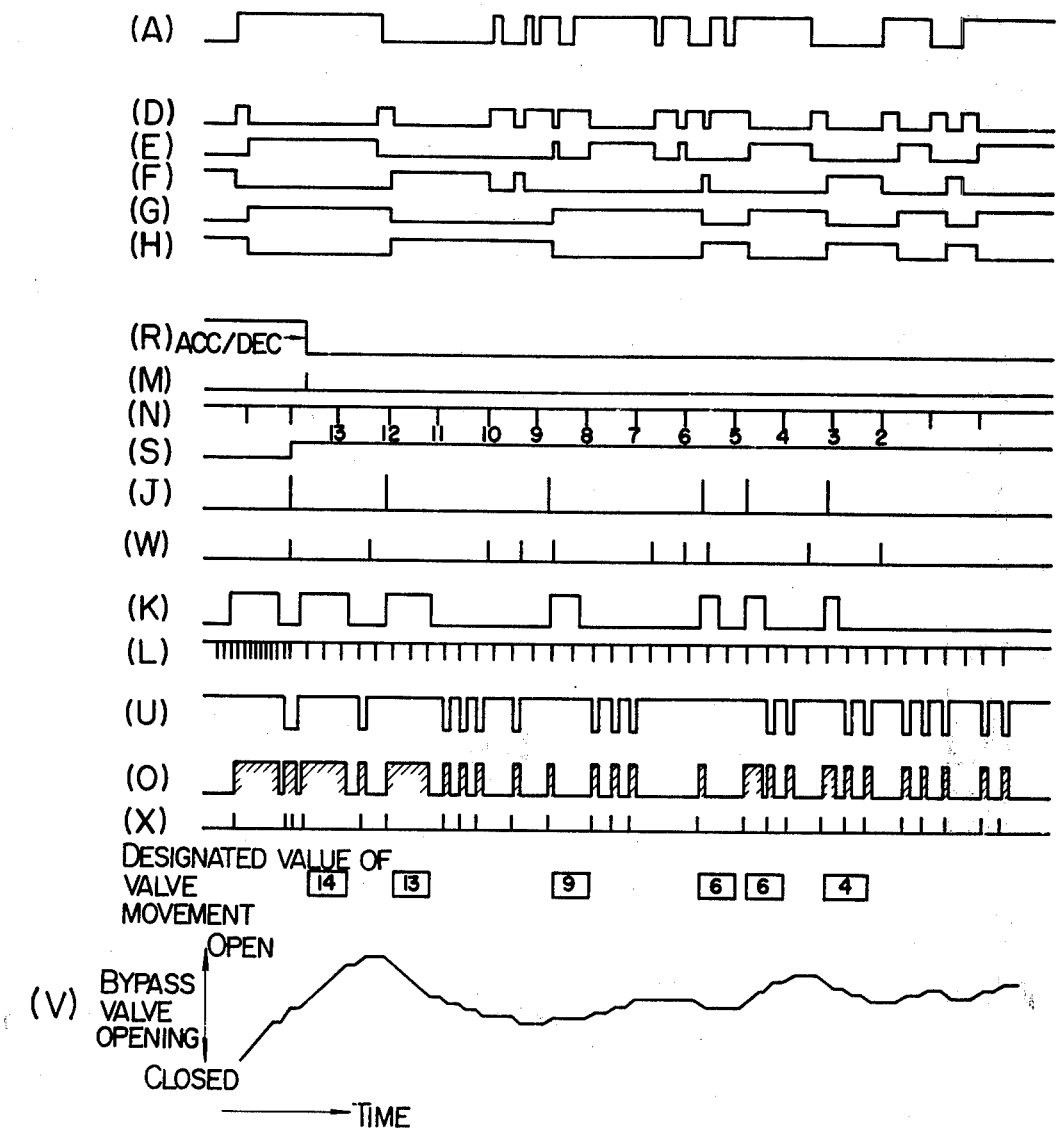
FIG. 5 is an operational waveform diagram which is useful in explaining the operation of the system of this invention.

The first trigger circuit generates trigger pulses at its terminal B in synchronism with the transition or rising and falling of the output signal, shown in (A) of FIG. 5, of the OP AMP 104 in the A/F discriminating circuit **20*a*, and the trigger pulses are used as reset signals for repeatedly actuating the timer circuit (115–124) so that the filter circuit 20*b* generates from its terminal D a "1" level signal for a predetermined time period from the application of a trigger pulse (filter signal) as shown in (D) of FIG. 5**.

A flip-flop circuit **20*c* comprises inverters 125, 128 and 129, NOR gates 126 and 127, and NAND gates 130 and 131 constituting an R-S flip-flop, and it receives as its input signals the outputs of the A/F discriminating circuit 20*a* and the filter circuit 20*b*. The flip-flop circuit 20*c* gates these two input signals, thus generating at its terminals E and F the pulse motor driving direction signals shown in (E) and (F) of FIG. 5. The driving direction signal shown in (E) of FIG. 5 is such that the positive-going transition is delayed by a time corresponding to the time duration of the filter signal (shown in (D) of FIG. 5) from a time when the A/F signal shown in (A) of FIG. 5 changes from "0" to "1" level, and the driving direction signal remains at the "0" level when the "1" level duration of the A/F signal is shorter than the "1" level duration of the filter signal. On the other hand, the driving direction signal shown in (F) of FIG. 5 is also responsive to the A/F signal shown in (A) of FIG. 5 and the signal from the filter circuit 20*b* shown in (D) of FIG. 5 so that positive-going transition of the driving direction signal is delayed by a time equal to the duration of the filter signal, and this driving direction signal remains at the "0" level when the "0" level duration of the A/F signal is shorter than the "1" level duration of the filter signal. The R-S flip-flop (130, 131) is triggered in response to the positive-going transition of the driving direction signals, thus generating from its terminals G and H the synchronizing signals shown in (G) and (H) of FIG. 5**.

A timing pulse circuit **20*d* comprises a reshaper circuit including resistors 200, 202 and 203, a capacitor 201 and a transistor 204, a binary counter 205, a dividing ratio selection circuit including an inverter 211, NAND gates 212, 213 and 214 and resistors 224 and 225, first, second and third monostable multivibrators formed with inverters 206, 215 and 219, resistors 207, 216 and 220, capacitors 208, 217 and 221, NAND gates 209 and 218 and a NOR gate 222, and inverters 210 and 223. Thus, the intermittent signals from the primary winding of the ignition coil of the ignition system constituting the rotational speed detector 14 are received as input signals, reshaped by the reshaper circuit and then applied as clock signals to the binary counter 205 which in turn divides the frequency of the input signals to generate the desired frequency divided output. The selection of the desired frequency divided output is effected by the dividing ratio selection circuit (211–225) which receives the necessary gating signal from the acceleration/deceleration sensor 15, whereby during steady-state operation the NAND gate 213 is opened to deliver an ⅛ division output from the terminal $Q_3$ of the binary counter 205 to the NAND gate 214, whereas during the periods of acceleration or deceleration the NAND gate 212 is opened to deliver a ½ division output from the terminal $Q_1$ of the binary counter 205 to the NAND gate 214. The output of the NAND gate 214 is subjected to pulse stretching by the second monostable multivibrator (215–218) which in turn generates from its terminal L a signal as shown in (L) of FIG. 5. In response to the switching operation of the acceleration/deceleration sensor 15, the third monostable multivibrator (219–222) generates a trigger pulse so that a signal as shown in (M) of FIG. 5 is generated from a terminal M, and an inverted signal of the signal shown in (M) of FIG. 5 is generated from a terminal $\overline{M}$. In the first monostable multivibrator (206–209), the 1/16 division output from the terminal $Q_4$ of the binary counter 205 is subjected to pulse stretching and then inverted by the inverter 210, thus producing signals as shown in (N) of FIG. 5**.

An oscillator circuit **20*e* comprises an astable multivibrator including inverters 226 and 227, resistors 228 and 229 and a capacitor 230, a binary counter 231 and inverter 232, whereby the astable multivibrator generates clock pulses of a fixed frequency, and the clock pulses are subjected to frequency division by the binary counter 231 whose output is in turn delivered through or the inverter 232**.

A reset pulse circuit **20*f* comprises a second trigger circuit including two monostable multivibrators formed with inverters 132 and 136, resistors 133 and 137, capacitors 134 and 138 and NAND gates 135 and 139, NAND gates 140 and 144, inverters 141 and 143 and NOR gates 142 and 145, a third trigger circuit including a NOR gate 146, inverters 147 and 148 and a NAND gate 149, and a fourth trigger circuit including a monostable multivibrator formed with an inverter 150, a resistor 151, a capacitor 152 and a NAND gate 153 and a NAND gate 154, and the circuit 20*f* receives as input signals the outputs of the filter circuit 20*b*, the flip-flop circuit 20*c*, the timing pulse circuit 20*d* and a clock pulse circuit 20*g*. In synchronism with the positive-going transition of the outputs shown in (G) and (H) of FIG. 5 and the negative-going transition of the acceleration/deceleration signal shown in (R) of FIG. 5, the second trigger circuit (132–145) generates the trigger pulses shown in (J) of FIG. 5 and the pulses are delivered from a terminal J. The third trigger circuit (146–149) gates the timing pulse (FIG. 5(L) from the timing pulse circuit 20*d* in response to the signals (FIG. 5(D) and FIG. 5(K)) from the filter circuit 20*b* and the clock pulse circuit 20*g* which will be described later, whereby when the output of the filter circuit 20*b* shown in (D) of FIG. 5 is at the "0" level and the (A > B) output of a comparator 254 in the clock pulse circuit 20*g* is at the "0" level, the NOR gate 146 is opened and the timing pulse from the timing pulse circuit 20*d* is delivered from a terminal Y. The output from the terminal Y is shown in (Y) of FIG. 5. This timing pulse from the NOR gate 146 is also added to the inverter 147. The trigger pulses (FIG. 5(J)) from the NAND gate 144 are applied to the inverter 148. Accordingly, the NAND gate 149 performs a logical operation with the pulses from the inverters 147 and 148 and generates a reset signal from a terminal X as shown in FIG. 5(X). In synchronism with the positive-going transition of the output (FIG. 5(D)) of the filter circuit 20*b*, the fourth trigger circuit (150–154) causes the monostable multivibrator (150–153) to generate a trigger pulse which in turn is applied to the NAND gate 154. The NAND gate 154 combines the trigger pulse from the NAND gate 153 with the output from the terminal $\overline{M}$ of the timing pulse circuit 20*d* and generates output signal at terminal W as shown in (W) of FIG. 5**.

The clock pulse circuit **20*g* comprises a first clock circuit including inverters 238, 244, 245, 246, 256, 258 and 260, NAND gates 237, 247, 257 and 259, resistors 240, 241, 242, 243, 249, 250, 251 and 252, an up-down counter 239 whose forward counting and reverse counting are selectively accomplished by switching the gate, a D-type latch circuit 248 for receiving and temporarily storing the digital data transferred thereto, an AND-OR selector gate 253 for selecting a digital data signal, the comparator 254 for performing comparison operation on digital data signals and a binary counter 255 for counting clock pulses, and a second clock circuit including an R-S flip-flop formed with NOR gates 233 and 234, a NOR gate 235 and a decade counter 236. The clock pulse circuit 20*g* receives as input signals the outputs of the filter circuit 20*b*, the timing pulse circuit 20*d*, the oscillator circuit 20*e* and the reset pulse circuit 20*f***.

During the acceleration/deceleration operation of the engine 1, the contacts **15*m*$_1$ and 15*m*$_2$ of the acceleration/deceleration sensor 15 are closed, so that the output (acceleration/deceleration-steady state discriminating signal) at the terminal R of the timing pulse circuit 20*d* goes to the "1" level, and this "1" level signal is applied to a $K_b$ terminal of the AND-OR selector gate 253. Thus, during the acceleration/deceleration period or transient period of the engine 1, the B-side input gates $B_1$ to $B_4$ of the AND-OR selector gate 253 are opened, and consequently a preset designated number is applied from its output terminals $D_1$ through $D_4$ to the A-side input terminals $A_1$ to $A_4$ of the comparator 254. The designated number can be preset by connecting the resistors 249 to 252** to either the ground or the power source. In this embodiment, the setting is such that $B_1 = 0$, $B_2 = 1$, $B_5 = 1$ and $B_4 = 1$, and thus the designated number is the binary number 1110 or the decimal number 14.

During other operations other than the acceleration or deceleration operation of the engine 1, the contacts **15*m*$_1$ and 15*m*$_3$ of the acceleration/deceleration sensor 15 are closed so that a "1" level signal is applied to a $K_a$ input terminal of the AND-OR selector gate 253 through the inverter 260 and its A-side input terminals are opened. The designated number applied to the A-side input terminals of the AND-OR selector gate 253 is dependent on the output stored in the D-type latch circuit 248**.

When the acceleration/deceleration-steady state discriminating signal goes from the "1" level to the "0" level as shown in (R) of FIG. 5, as shown in (M) of FIG. 5, a "1" level trigger pulse is generated as the output of the third monostable multivibrator (219–222) in the timing pulse circuit 20*d*, and this trigger pulse is applied to the terminal P.E. of the up-down counter 239. The up-down counter 239 is adapted to count in the reverse direction or count down, so that when the "1" level trigger pulse is applied to the terminal P.E. of the up-down counter 239, it starts counting down the designated number applied to its J-side input terminals $J_1$ to $J_4$ in response to the positive-going transition of clock pulses applied to its clock terminal. In this case, the designated number can be set by connecting the resistors 240 to 243 to either the ground or the power source as in the case of the AND-OR selector gate 253, and in this embodiment the setting is such that $J_1 = 0$, $J_2 = 1$, $J_3 = 1$ and $J_4 = 4$ and thus the designated number is the binary number 1110 or the decimal number 14. The clock terminal of the up-down counter 239 receives the signal from the NAND gate 237 through the inverter 238, and the NAND gate 237 receives the output of the first monostable multivibrator (206–210) in the timing pulse circuit 20*d* and the output of the NAND gate 247.

When the "1" level signal is applied to the P.E. terminal of the up-down counter 239 from the terminal M of the timing pulse circuit 20*d*, the input signals of the binary number on the input terminals $J_1$ to $J_4$ appear on the output terminals $Q_1$ to $Q_4$.

Accordingly, the output of the NAND gate 247 goes to the "1" level as shown in (S) of FIG. 5 in response to the application of the trigger pulse to the terminal P.E. of the up-down counter 239 thus causing the counter to start counting down for every clock pulse from the inverter 238. When the outputs $Q_1$ to $Q_4$ of the up-down counter 239 indicate the binary number 0010 (the decimal number 2), the output of the NAND gate 247 goes to the "0" level as shown in (S) of FIG. 5, thus closing the NAND gate 237 by this "0" level signal and thereby causing the up-down counter 239 to stop counting. As noted above, when a transition occurs from the acceleration/deceleration operation to the steady-state operation, the up-down counter 239 comes into operation so that in synchronism with the timing pulses shown in (N) of FIG. 5 the count is gradually counted down from the indicated decimal number "14" to "2", thus gradually decreasing the designated number in synchronism with the engine rotation. Along with this operation, the D-type latch circuit 248 adapted to receive the outputs $Q_1$ to $Q_4$ of the up-down counter 239 as input signals to its D-side input terminals $D_1$ to $D_4$, reads in the output data of the up-down counter 239 in synchronism with the negative-going transition of the clock pulses applied to the clock terminal from the terminal W of the reset pulse circuit 20*f* as shown in (W) of FIG. 5, and the data is then applied through its Q-side output terminals $Q_1$ to $Q_4$ and through the AND-OR selector gate 253 to the A-side input terminals $A_1$ to $A_4$ of the comparator 254.

The binary counter 255 receives as its reset signal the trigger pulse from the terminal J shown in (J) of FIG. 5, and in synchronism with this reset signal the counter 255 counts the clock pulses from the oscillator circuit 20*e* and applies its outputs $Q_1$ to $Q_4$ (the count number) to the B-side input terminals $B_1$ to $B_4$ of the comparator 254.

In this way, the designated number A is applied to A-side input terminals of the comparator 254 and the count number B is applied to the B-side input terminals of the comparator 254, thus causing the comparator 254 to compare the two inputs as to relative magnitude. When the designated number A is greater than the count number B or $A > B$, the $(A > B)$ output of the comparator 254 goes to the "1" level, and this "1" level signal is applied to the NAND gate 257. In other words, the $(A > B)$ output goes to "0" level when the count number B becomes equal to the designated number A. The NAND gate 257 gates the clock pulses from the oscillator circuit 20*e* in response to the output of the filter circuit 20*b* (the output from the terminal D and the $(A > B)$ output of the comparator 254, and consequently the clock pulses are applied to the binary counter 255 when the output (the output from the terminal D as shown in (D) of FIG. 5) of the filter circuit 20*b* is at the "0" level and the $(A > B)$ output of the comparator 254 is at the "1" level.

After the designated number of the clock pulses have been counted by the binary counter 255, the $(A > B)$ output of the comparator 254 goes to the "0" level and the NAND gate 257 is closed, thus causing the binary counter 255 to stop counting. The counting operation of the binary counter 255 is stopped until the next reset signal is applied to it from the terminal J of the reset-pulse circuit 20*f*.

The $(A > B)$ output of the comparator 254 as well as the filter signal from the terminal D is also applied to the NOR gate 146 in the third trigger circuit (146–149) of the reset pulse circuit 20*f* as described above, so that in response to the "0" level signal generated from the comparator 254 after the counting of the designated number as well as the "0" level signal from the terminal D, the NOR gate 146 is opened to deliver the timing pulse from the terminal L and thereby a reset signal shown in (Y) of FIG. 5 is applied to the second clock circuit (233–236) through the terminal Y. The decade counter 236 in the second clock circuit (233–236) is reset by the "1" level reset signal applied to its reset terminal R from the NOR gate 146 and all of its outputs are reset to the "0" level. The counting occurs in response to the transition from the "0" level to the "1" level of the timing pulses applied to its carry-in terminal CI from the oscillator circuit 20*e* through the NOR gate 235, and a "1" signal is generated one at a time at $Q_0$, $Q_1$, ..., and $Q_9$ in this order.

Also, in the R-S flip-flop comprising the NOR gates 233 and 234, the NOR gate 233 is triggered by the trigger pulse (reset signal) from the third trigger circuit (146–149) through the terminal Y, so that the output of the NOR gate 233 goes to the "0" level and this "0" level signal opens the NOR gate 235, thus passing the clock pulses from the oscillator circuit 20*e* through the NOR gate 235. At the same time, the decade counter 236 is reset by the trigger pulse from the third trigger circuit (146–149) as dscribed above, so that the second clock circuit (233–236) starts counting the clock pulses in response to the arrival of the trigger pulse, and its output $Q_i$ goes to the "1" level in response to the counting of the i clock pulses, thus triggering the NOR gate 234 of the R-S flip-flop. Consequently, the output of the NOR gate 233 goes to the "1" level, and this "1" level signal closes the NOR gate 235, thus causing the second clock circuit (233–236) to stop counting. Thus, in response to each trigger pulse from the terminal Y as shown in (Y) of FIG. 5, the NOR gate 235 passes i clock pulses as shown in (U) of FIG. 5.

Thus, during the periods of transient engine operation, e.g., the periods of acceleration, deceleration or the like, the clock circuit 20g causes the first clock (237 through 257) circuit to generate the maximum of 14 clock pulses after which the second clock circuit (233 through 236) generates clock pulses in accordance with the engine rotational speed and the acceleration/deceleration of the engine 1. During transition of the engine operation from the acceleration/deceleration to the steady-state condition as above, the number of the output clock pulses from the first clock circuit (237 to 257) is decreased gradually in synchronism with the engine rotation, and the second clock circuit (233 to 236) generates intermittently i clock pulses at a period synchronized with the engine rotation.

The output of the NAND gate 257 in the first clock circuit (237 to 257) and the output of the NOR gate 235 of the second clock circuit (233 to 236) through the inverter 258 are applied to the NAND gate 259 from which the signals are applied to a command circuit 20h as shown in (Q) of FIG. 5.

The fully closed position sensor 12 comprises a resistor 12a and contacts 12b, whereby when the by-pass valve 10 is fully closed, the contacts 12b are closed and a "O" level signal is generated from its output terminal Z.

The command circuit 20h comprises NAND gates 261 and 262, and it gates the clock pulses shown in (Q) of FIG. 5 from the clock pulse 20g in response to the driving direction signals shown in (E) and (F) of FIG. 5 from the flip-flop circuit 20c and the full closed signal from the fully closed position sensor 12.

A reversible shift register 20j is of a known type in which its outputs $Q_1$, $Q_2$, $Q_3$ and $Q_4$ are sequentially shifted in this order in response to the clock pulses applied to its input terminal P, whereas the output terminals $Q_4$, $Q_3$, $Q_2$ and $Q_1$ are sequentially shifted in this order in response to the clock pulses applied to its input terminal C. These output terminals are connected to a switching circuit 20j comprising resistors 170, 171, 172 and 173, transistors 174, 175, 176 and 177 and back electromotive force absorbing diodes 178, 179, 180 and 181, and the switching circuit 20j is connected to field coils $C_1$, $C_2$, $C_3$ and $C_4$ of the pulse motor 11.

Figure 4:
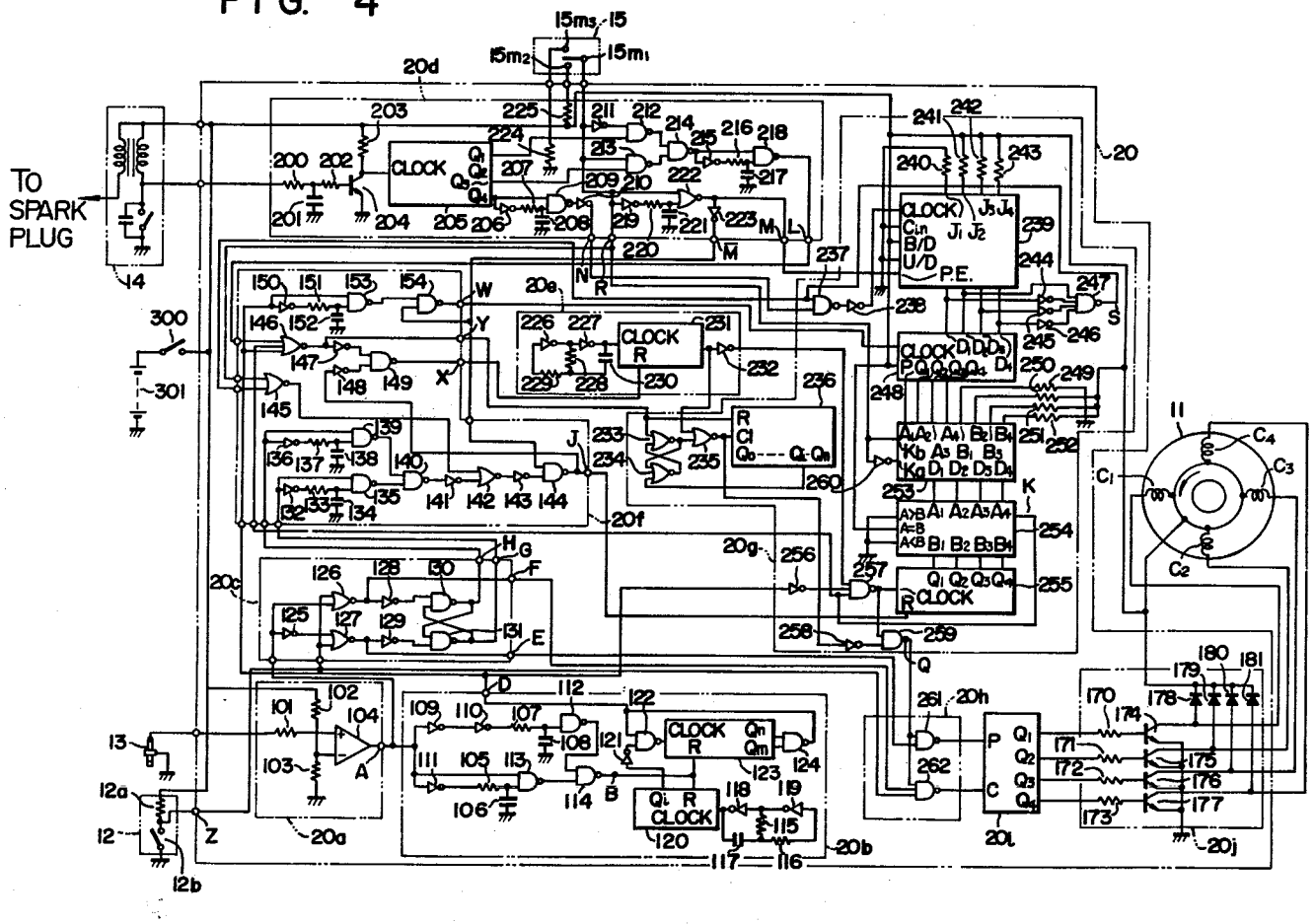
FIG. 4 is a circuit diagram of the control unit shown in FIG. 1.

Thus, when the clock pulses are applied to the input terminal P of the reversible shift register 20i, the transistors 174 to 177 are squentially turned on and the field coils $C_1$, $C_2$, $C_3$ and $C_4$ of the pulse motor 11 are energized two phases at a time, thus rotating the rotor of the pulse motor 11 in the direction of the arrow shown in FIG. 4 and thereby rotating the by-pass valve 10 in a direction to open. On the contrary, when the clock pulses are applied to the input terminal C, the pulse motor 11 is rotated in a direction opposite to the direction of the arrow shown in FIG. 4, and the by-pass valve 10 is rotated in a direction which closes it.

The control unit 20 and the pulse motor 11 are supplied with power from a battery 301 through a switch 300 operatively associated with the key switch of the engine 1.

With the construction described above, the carburetor 2 is designed to perform the ordinary fuel metering function, and it is the same with the known carburetors except that it has been adjusted to produce a mixture which is slightly thick in fuel as compared with the desired mixing ratio of air and fuel to be controlled and obtained. And the ordinary primary air is mixed with the corresponding fuel and supplied to the engine 1 through the carburetor 2. After the mixture has been burned in the engine 1, the resulting exhaust gases are discharged to the atmosphere through the exhaust manifold 4 and the catalytic converter 5.

The air-fuel ratio of the mixtures produced in the carburetor 2 will be varied by various causes so that the output electromotive force V of the gas sensor 13 changes in accordance with change in the air-fuel ratio as shown in FIG. 2. Consequently, in response to the electromotive force V, the A/F discriminating circuit 20a generates a "1" or "0" level signal as shown in (A) of FIG. 5. When this output signal changes its state, the first trigger circuit of the filter circuit 20b generates a trigger pulse, and consequently the timer circuit (115–124) generates the stop signal (filter signal) shown in (D) of FIG. 5. As long as the stop signal remains at the "1" level, the outputs of the NOR gates 126 and 127 of the flip-flop circuit 20c remain at the "0" level and the NAND gate 261 and 262 of the command circuit 20h are closed, thus temporarily stopping the pulse motor 11 or the by-pass valve 10. Thus, even if the output signal of the gas sensor 13 is changed instantaneously so that the A/F discriminating circuit 20a generates an instantaneous pulse or even if the air-fuel ratio of the mixtures is at around the preset air-fuel ratio (the stoichiometric ratio) so that the output of the A/F discriminating circuit 20a changes its state at short periods, the pulse motor 11 is not operated and consequently the by-pass valve 10 is kept at rest. In this way, the by-pass valve 10 is prevented from malfunctioning or changing its direction of movement at short periods, and the air-fuel ratio of the mixture is stably controlled. When the stop signal (filter signal from the terminal D) goes to the "0" level and the output of the NAND gate 247 of the first clock circuit (237 to 257) goes to the "1" level as shown in (S) of FIG. 5, the second trigger circuit (132 to 145) of the reset pulse 20f generates the trigger pulse shown in (J) of FIG. 5.

In response to this trigger pulse, the clock pulse circuit 20g generates clock pulses as shown in (Q) of FIG. 5 in the manner as previously mentioned.

The command circuit 20h gates these clock pulses in response to the driving direction signals from the flip-flop circuit 20c, and the pulse motor 11 is operated through the reversible shift register 20i and the switching circuit 20j. In this way, whether the mixture is thick or thin as compared with a mixture of the stoichiometric air-fuel ratio is determined, so that when the mixture is thick the pulse motor 11 is stopped for a predetermined time period and then the pulse motor 11 operates the by-pass valve 10 mounted in the additional air passage 9 in a direction which opens it, whereas when the mixture is thin the pulse motor 11 is stopped for a predetermined time period and the the by-pass valve 10 is operated in a direction which closes it, thus correcting the air-fuel ratio by additional air and thereby controlling the air-fuel ratio at the stoichiometric ratio.

During the transient operation designated by ACC/-DEC in (R) of FIG. 5, e.g., during the periods of acceleration and deceleration of the engine 1, the running time of the pulse motor 11 is increased to increase the rate of change in the opening or closing of the by-pass valve 10 as shown in the left-hand portion of (V) in FIG. 5, and the amount of additional air is controlled to satisfactorily follow up or respond to the rapid change in the air-fuel ratio and compensate the air-fuel ratio satisfactorily.

On the other hand, during the steady-state operation, the by-pass valve 10 is operated by the first clock circuit (237–257) of the clock pulse circuit 20*g* rapidly to move a reduced designated amount in a skip movement fashion, and thereafter the pulse motor 11 is operated intermittently at a period corresponding to the system delay time or synchronized with the engine rotation, thus decreasing the driving speed of the by-pass valve 10 on the whole and thereby decreasing the rate of change in the opening of the by-pass valve 10 as shown in the right-hand portion of (V) in FIG. 5.

Thus, during the periods of steady-state operation, the by-pass valve 10 is operated at a low speed corresponding to the system delay time, thus eliminating any excessive control or overshooting of the by-pass valve 10, preventing the supply of excessive additional air during the steady-state operation and reducing variation of the air-fuel ratio, thereby preventing the occurrence of surging phenomenon of the engine 1.

Further, upon transition from the transient operation to the steady-state operation of the engine 1, the designated number of clock pulses generated from the first clock circuit (237–257) of the clock pulse circuit 20*g* or the designated amount of movement of the by-pass valve 10 is gradually decreased, thus gradually decreasing the rate of change in the opening of the by-pass valve 10 and thereby ensuring an improved intermediary characteristic during transition from the acceleration/deceleration operation to the steady-state operation. In other words, if transition from the transient control to the steady-state control is effected rapidly, the driving speed of the by-pass valve 10 will be decreased rapidly with the result that depending on the position of the by-pass valve 10 at that time, the amount of additional air will not be controlled satisfactorily thus increasing variation of the air-fuel ratio. In accordance with the present invention, however, it becomes possible to shift the position of the by-pass valve 10 to a position which is suitable for the steady-state control through the intermediary characteristic of gradually decreasing the driving speed of the by-pass valve 10 in synchronism with the engine rotation; thus, it does not occur that the variation of the air-fuel ratio becomes large.

In this way, the variation in the air-fuel ratio of the mixtures can always be maintained small, thus enabling the catalytic converter 5 to purify the exhaust gases with greater efficiency and improving the drivability of the vehicle.

In the above-described operation, in order to prevent the A/F discriminating circuit 20*a* from continuously rotating the by-pass valve 10 and moving it into an "overshoot" position due to the failure of the mixture reaching the desired air-fuel ratio even after the by-pass valve 10 has been moved into its fully closed position, when the fully closed position sensor 12 detects that the by-pass valve 10 is in its fully closed position, the NAND gate 262 is closed so that the pulse signals are no longer supplied to the reversible shift register 20*i* and the pulse motor 11 is prevented from operating the by-pass valve 10 in a direction which closes it.

While, in the above-described embodiment, the system of this invention is applied to the control of additional air supplied to the intake system of an engine, the system may be applied to the control of secondary air supplied to the exhaust system.

Further, while the rotational speed detector 14 and the acceleration/deceleration sensor 15 are used, other sensors adapted for detecting the amount of air drawn into the engine 1, the throttle opening, the vehicle speed, etc., may also be used.

Still further, the designated amount of movement of the by-pass valve is gradually decreased with timing pulses having a period corresponding to the engine rotation, the designated amount of movement may be gradually decreased with timing pulses having a fixed period.

What is claimed is:

1. In an air-flow control system for an internal combustion engine comprising:

a combustion chamber for producing a power therein;

an intake system operatively communicated with said combustion chamber for supplying thereto air-fuel mixture;

an exhaust system operatively communicated with said combustion chamber for conveying exhaust gas from said combustion chamber to the atmosphere;

an additional air supply pipe communicated with at least one of said intake and exhaust systems for supplying additional air thereto;

air-fuel ratio detecting means disposed in said exhaust system for detecting air-fuel ratio of the air-fuel mixture supplied with the additional air;

control means operatively disposed in said additional air supply pipe for controlling the amount of the additional air to be supplied;

drive means operatively connected with said control means for driving the same;

an acceleration/deceleration sensor for detecting acceleration or deceleration of said engine; and a control circuit, electrically connected to said air-fuel ratio detecting means, said drive means and said acceleration/deceleration sensor, for actuating said drive means in response to signals from said air-fuel ratio detecting means and said acceleration/deceleration sensor so that the air-fuel ratio is controlled to a desired ratio by the additional air, the improved circuit comprising:

a first circuit for generating a first signal during at least steady-state operation to thereby intermittently actuate said drive means;

a second circuit for generating a second signal during an acceleration or deceleration operation of said engine to thereby intermittently actuate said drive means, wherein the time duration of each actuation of said drive means during the acceleration or deceleration operation is larger than that during the steady-state operation; and a third circuit for generating a third signal during a transitional operation of said engine from the acceleration or deceleration to the steady-state operation to thereby intermittently actuate said drive means, wherein the time duration of each actuation of said drive means is decreased gradually from that during the acceleration or deceleration operation to that during the steady-state operation thereby to improve intermediary characteristics during a transition period from the acceleration or deceleration operation to the steady-state operation.

2. The improved control circuit according to claim 1, further comprises:

a fourth circuit connected to said air-fuel ratio detecting means for comparing the output therefrom with a preset level and for generating a high level or a low level signal based on the comparison; and a fifth circuit connected to said fourth circuit for generating a fifth signal to thereby stop the actuation of said drive means for a period at each time when the signal from said fourth circuit is changed from one level to the other level.

3. The improved control circuit according to claim 1, wherein said first circuit also generates said first signal during said transitional operation to thereby intermittently actuate said drive means at a time during which said drive means is not actuated by said third circuit.

4. The improved control circuit according to claim 1, wherein the intermittent actuation of said drive means by said first control circuit responds to the running speed of said engine.

5. The improved control circuit according to claim 1, the decreasing operation for the amount of each actuation of said drive means by said third circuit responds to the running speed of said engine.

* * * * *